US007340927B2

(12) United States Patent
Yu et al.

(10) Patent No.: US 7,340,927 B2
(45) Date of Patent: Mar. 11, 2008

(54) PADLOCK

(76) Inventors: Chun Te Yu, No. 253, Sec. 3, Yanhai Rd., Fusing Township, Changhua County 506 (TW); Cory O. Nykoluk, 1536 Irvine Ct., Oakdale, CA (US) 95361

( * ) Notice: Subject to any disclaimer, the term of this patent is extended or adjusted under 35 U.S.C. 154(b) by 0 days.

(21) Appl. No.: 11/889,702

(22) Filed: Aug. 15, 2007

(65) Prior Publication Data

US 2007/0289343 A1 Dec. 20, 2007

Related U.S. Application Data

(62) Division of application No. 10/671,659, filed on Sep. 29, 2003.

(51) Int. Cl.
*E05B 37/02* (2006.01)

(52) U.S. Cl. ..... 70/21; 70/25; 70/284; 70/285; 70/379 R; 70/DIG. 63; 70/DIG. 71

(58) Field of Classification Search ..... 70/21, 70/24–26, 284, 285, DIG. 63, DIG. 71, 30, 70/49, 38 R, 38 A, 38 B, 29, 38 C, 379 R, 70/379 A, 380
See application file for complete search history.

(56) References Cited

U.S. PATENT DOCUMENTS

| | | | | | |
|---|---|---|---|---|---|
| 1,550,379 | A * | 8/1925 | Manteufel | 70/492 |
| 1,564,463 | A * | 12/1925 | Best | 70/380 |
| 1,622,999 | A * | 3/1927 | Frith | 70/38 A |
| 2,497,619 | A * | 2/1950 | Adolph | 70/25 |
| 3,349,584 | A * | 10/1967 | Russell et al. | 70/21 |
| 3,472,049 | A * | 10/1969 | Sewell | 70/21 |
| 3,729,962 | A * | 5/1973 | Harrington et al. | 70/25 |
| 3,823,584 | A * | 7/1974 | Gill | 70/21 |
| 3,894,415 | A * | 7/1975 | Bako | 70/21 |
| 3,952,559 | A * | 4/1976 | Atkinson | 70/25 |
| 4,462,231 | A * | 7/1984 | Zabel | 70/21 |
| 4,876,866 | A * | 10/1989 | Fleming et al. | 70/379 R |
| 5,263,348 | A * | 11/1993 | Wittwer | 70/379 R |
| 5,363,678 | A * | 11/1994 | Meckbach | 70/38 A |
| 6,035,672 | A * | 3/2000 | Lai | 70/25 |
| 6,085,558 | A * | 7/2000 | Strathmann | 70/153 |
| 6,644,076 | B2 * | 11/2003 | Huang | 70/379 R |
| 6,708,534 | B1 * | 3/2004 | Ruan | 70/38 A |
| 6,877,345 | B1 * | 4/2005 | Misner et al. | 70/25 |
| 2002/0088256 | A1 * | 7/2002 | Taylor et al. | 70/25 |
| 2003/0000264 | A1 * | 1/2003 | Yang | 70/25 |
| 2004/0226324 | A1 * | 11/2004 | Loughlin et al. | 70/25 |
| 2005/0039501 | A1 * | 2/2005 | Yu | 70/29 |
| 2005/0044901 | A1 * | 3/2005 | Yu | 70/25 |
| 2005/0132762 | A1 * | 6/2005 | Yu | 70/25 |

* cited by examiner

*Primary Examiner*—Lloyd A. Gall
(74) *Attorney, Agent, or Firm*—Rosenberg, Klein & Lee

(57) ABSTRACT

A padlock can be unlocked by an owner dialing an unlocking number or security personnel using a general key. The padlock includes a lock body, a block, a shackle, a general locking device and a private locking device. The lock body includes a first channel and a second channel therein. The block is inserted in the second channel. The block includes a receptacle therein. The shackle includes a long arm movably disposed in the first channel and a short arm for engagement with the receptacle of the block. The general locking device is disposed in the lock body for locking and unlocking the long arm of the shackle. The private locking device is disposed in the lock body for controlling the block so that the block can be engaged with and disengaged from the short arm of the shackle.

3 Claims, 16 Drawing Sheets

PADLOCK

CROSS-REFERENCE

The present application is a divisional application of U.S. patent application Ser. No. 10/671,659 filed on 29 Sep. 2003 of which the disclosure is incorporated herein.

BACKGROUND OF INVENTION

1. Field of Invention

The present invention relates to a padlock and, more particularly, to a padlock including a shackle locked by key-operable locking means at an end and locked by combination locking means at another end so that the padlock can be unlocked by using a key or dialing the combination locking means to an unlocking number.

2. Related Prior Art

To prevent belongings from missing, travelers usually lock their trunks, suitcases, briefcases, bags or the like. A combination lock is the most common lock installed in a trunk because it takes little space. Each traveler sets up an unlocking number for the combination lock. Thereby, others cannot unlock his trunk without knowing the unlocking number. However, terrorists may use trunks to deliver explosives. In airports, security personnel may have to check travelers' trunks without their presence. In some countries, travelers are required not to lock their trunks. The travelers may lose their belongings if leaving their trunks unlocked. If the travelers lock their trunks, the security personnel are authorized to break the trunks for security check. There is a dilemma between the travelers' rights and the flight safety. Therefore, there is a need for padlocks that can protect the travelers' belongings and allow the security personnel to unlock them.

SUMMARY OF INVENTION

It is therefore an objective of the present invention to provide a padlock that can be unlocked by an owner dialing an unlocking number or security personnel using a general key.

According to the present invention, a padlock includes a lock body, a block, a shackle, general locking means and private locking means. The lock body includes a first channel and a second channel therein. The block is disposed in the second channel. The block includes a receptacle therein. The shackle includes a long arm movably disposed in the first channel and a short arm for insertion in the receptacle of the block. The general locking means is disposed in the lock body for locking and unlocking the long arm of the shackle. The private locking means is disposed in the lock body for controlling the block so that the block can be engaged with and disengaged from the short arm of the shackle.

BRIEF DESCRIPTION OF DRAWINGS

The present invention will be described via the detailed illustration of embodiments referring to the drawings wherein.

DETAILED DESCRIPTION OF EMBODIMENTS

Figure 2:
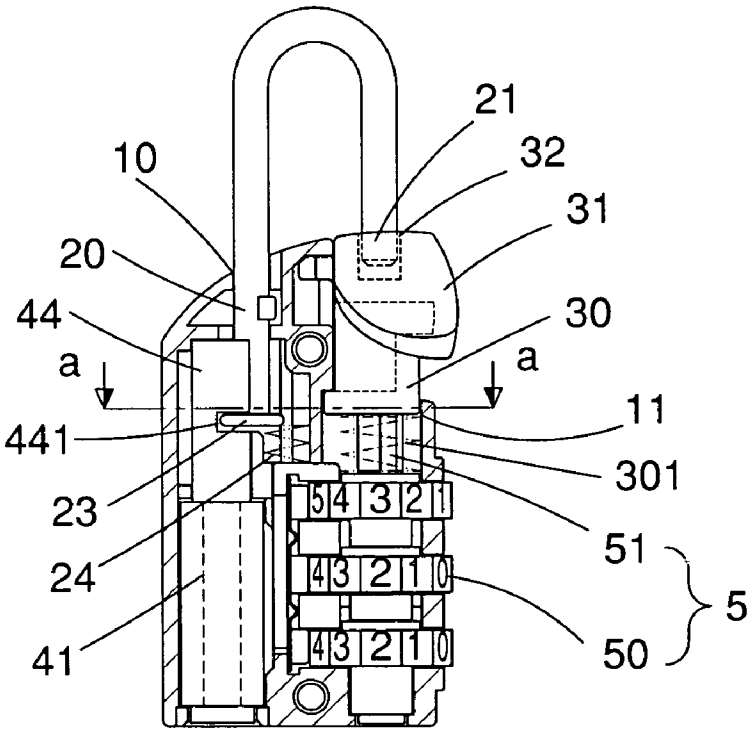
FIG. 2 is a cross-sectional view of the padlock in a locked position.
Figure 1:
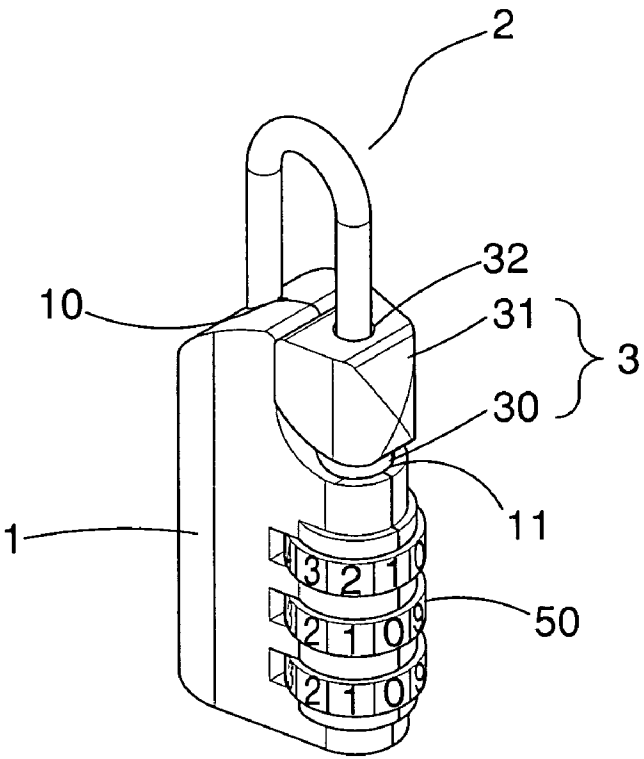
FIG. 1 is a perspective view of a padlock according to a first embodiment of present invention.

With reference to FIGS. 1 and 2, a padlock includes a lock body 1, a block 3, a shackle 2, key-operable locking means 4 and combination locking means 5 according to a first embodiment of the present invention. The lock body 1 includes a first channel 10 and a second channel 11 therein.

The block 3 includes a mounting portion 30, an engaging portion 31 formed on the mounting portion 30 and a receptacle 32 defined in the engaging portion 31. The mounting portion 30 is disposed in the second channel 11 of the lock body 1. The engaging portion 31 is located outside the second channel 11 of the lock body 1.

The shackle 2 includes a long arm 20 movably disposed in the first channel 10 and a short arm 21 for insertion in the receptacle 32 of the block 3. The long arm 20 of the shackle 2 includes a flange 23 near an end thereof.

The combination locking means 5 is disposed in the lock body 1 for controlling the block 3 so that the block 3 can be engaged with and disengaged from the shackle 2. The combination locking means 5 includes a stem 51 connected to the mounting portion 30 and plural number wheels 50 rotationally mounted on the stem 51 for controlling the stem 51 and therefore the block 3.

The key-operable locking means 4 is disposed in the lock body 1 for locking and unlocking the long arm 20 of the shackle 2.

Figure 4:
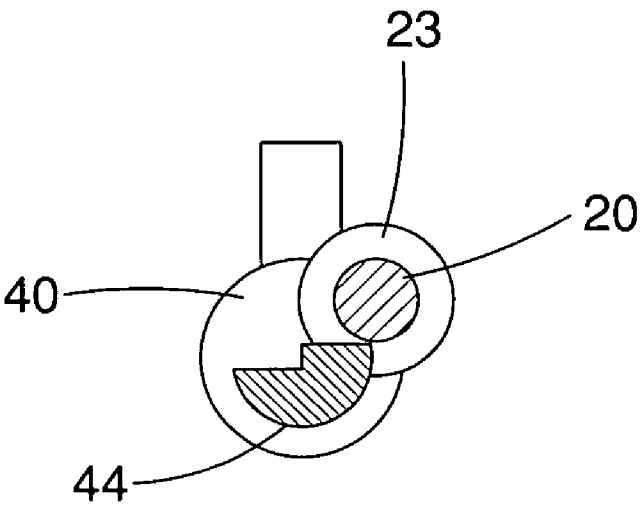
FIG. 4 is a cross-sectional view of the padlock, showing the key-operable locking means engaged with a flange of a long arm of a shackle.
Figure 3:
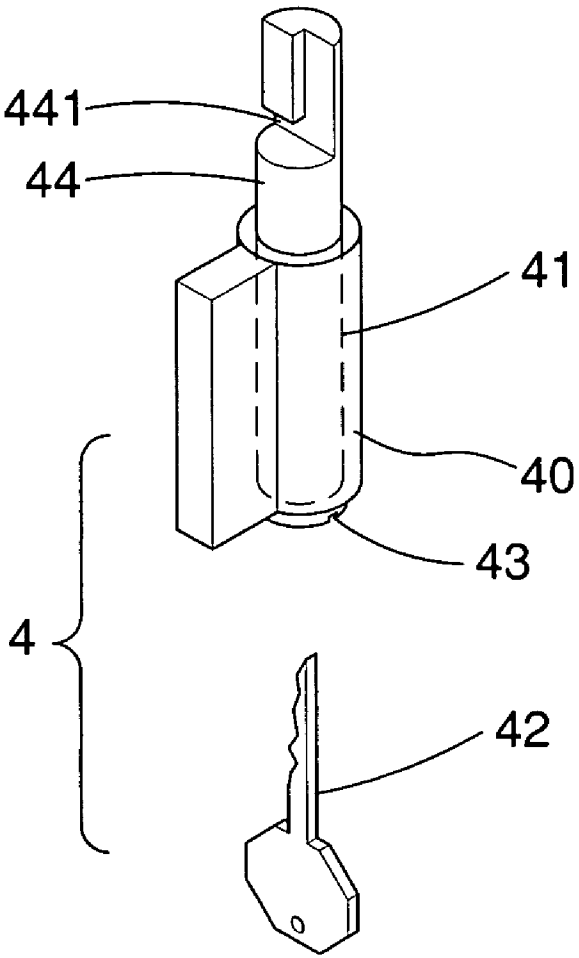
FIG. 3 is a perspective view of key-operable locking means used in the padlock.
Figure 7:
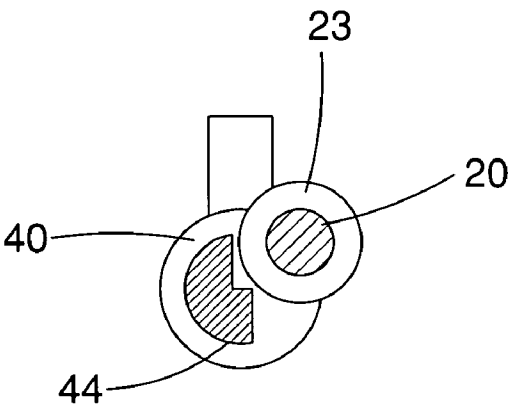
FIG. 7 is a cross-sectional view of the padlock, showing the flange of the long arm of the shackle released from the key-operable locking means.
Figure 10:
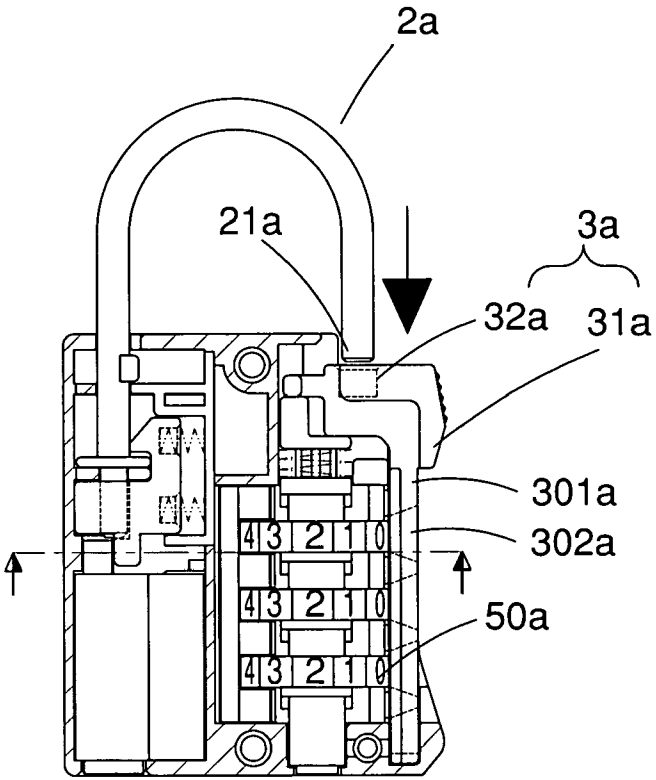
FIG. 10 is another cross-sectional view of the padlock shown in FIG. 8, showing the block moved downwardly and a short arm of the shackle disengaged from the block.

Referring to FIGS. 3, 4 and 7, the key-operable locking means 4 includes a body 40, a rotor 41 disposed in the body 40 and a driving rod 44 extended from the rotor 41. The rotor 41 includes a keyhole 43 therein for receiving a key 42. The driving rod 44 includes a notch 441 therein for receiving the flange 23 of the long arm 20 of the shackle 2. The key 42 can rotate the rotor 41 and the driving rod 44 to disengage the notch 441 from the flange 23.

Figure 5:
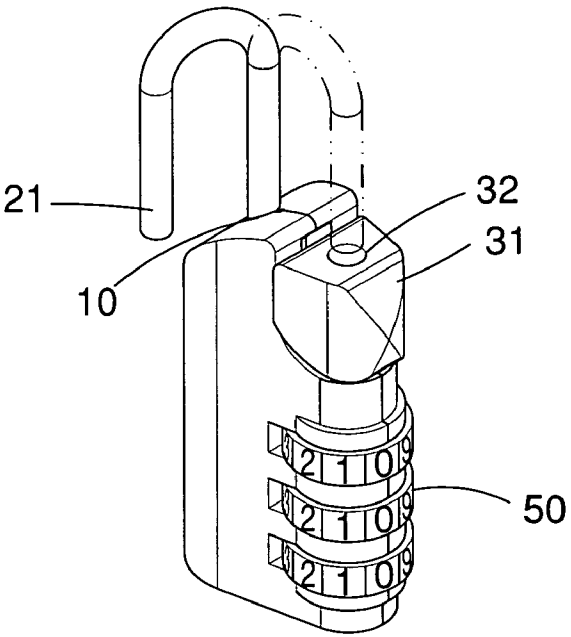
FIG. 5 is a perspective view of the padlock, showing a block moved downwardly and a short arm of the shackle removed from the block.
Figure 8:
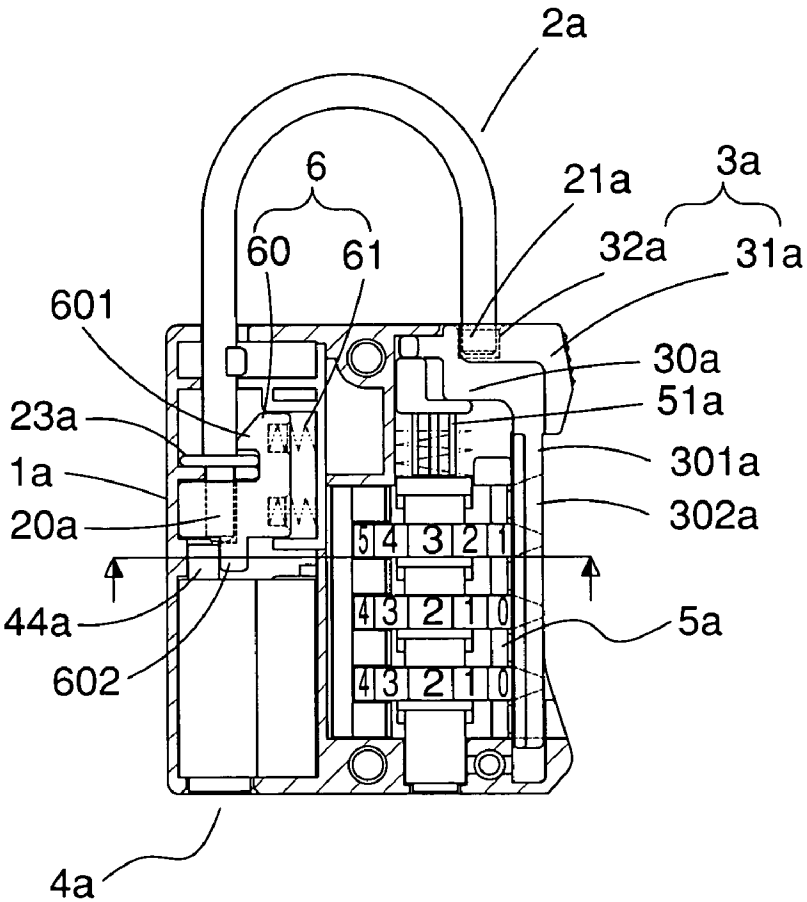
FIG. 8 is a cross-sectional view of a padlock according to a second embodiment of the present invention, showing a shackle locked.

With reference to FIGS. 2 and 5, when the number wheels 50 are dialed to an unlocking number, the stem 51 can be moved vertically. As the stem 51 is connected to the mounting portion 30 of the block 3 formed beneath the engaging portion 31, the engaging portion 31 of the block 3 can be moved downwardly and the short arm 21 of the shackle 2 can be removed from the receptacle 32 of the block 3.

Figure 6:
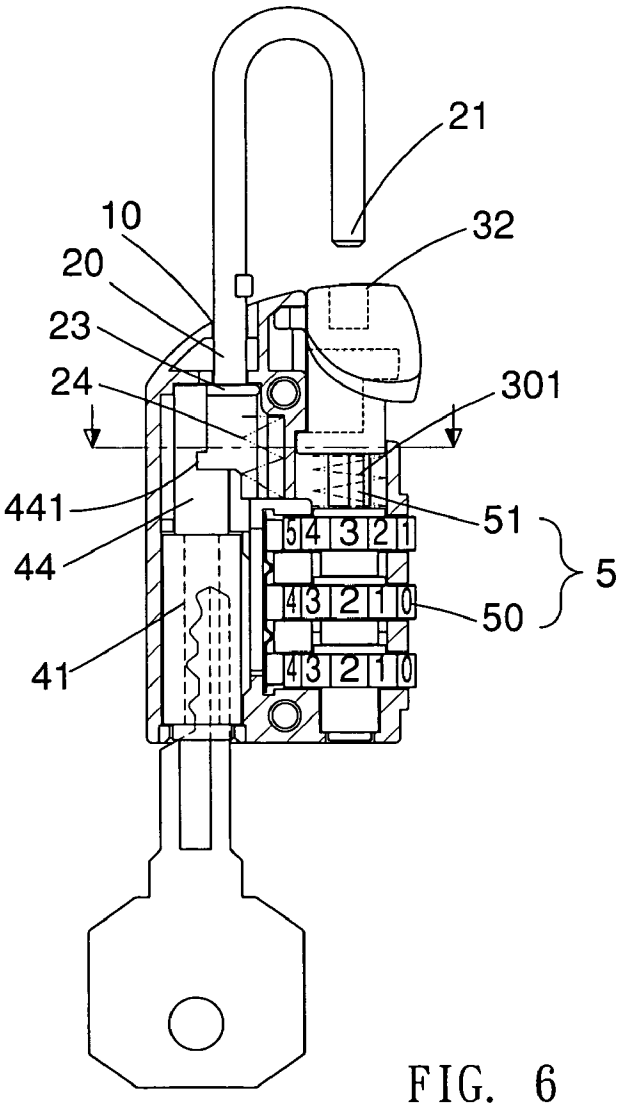
FIG. 6 is a cross-sectional view of the padlock, showing the long arm of the shackle released from the key-operable locking means.

Referring to FIGS. 2 and 6, a first spring 24 is engaged with the flange 23 of the long arm 20 of the shackle 2 for biasing the shackle 2. When the notch 441 is not engaged with the flange 23, the spring 24 ejects the long arm 20 of the shackle 2 automatically. Because the shackle 2 is rigid, the short arm 21 is also moved out of the receptacle 23 of the block 3 when the long arm 20 is ejected.

With reference to FIGS. 2 and 5, a second spring 301 is compressed between the combination locking means 5 and the block 3. The second spring 301 can return the block 3 to its original position so that the receptacle 32 can be engaged with the short arm 21 of the shackle 2 again.

As discussed above, the short arm 21 of the shackle 2 can be removed from the receptacle 23 of the block 3 by using the key 42 to unlock the key-operable locking means 4 or dialing the number wheels 50 to an unlocking number. Padlock manufacturers can be requested by governments having security concerns to make padlocks with identical key-operable locking means 4. Thus, these padlocks can be unlocked by the security personnel using the key 42. However, users can set specific unlocking numbers of the combination locking means 5 of these padlocks and unlocking the padlocks by dialing the specific unlocking numbers. Accordingly, the users can prevent belongings from missing and the security personnel can open the padlock when necessary while others cannot open the padlock.

Referring to FIGS. 8 through 11, a padlock according to a second embodiment of the present invention is shown. The second embodiment includes a lock body 1*a*, a block 3*a*, a shackle 2*a* and combination locking means 5*a* like the lock body 1, the block 3, the shackle 2 and the combination locking means 5 of the first embodiment. However, the block 3*a* further includes a hood 301*a* mounted thereon. The hood 301*a* is movable synchronously with the block 3*a*. The hood 301*a* includes plural windows 302*a* therein, corresponding to the number wheels 50*a* of the combination locking means 5*a*. When the padlock is locked, the hood 301*a* covers the number wheels 50*a* so that the number wheels 50*a* cannot be reached. If the padlock is unlocked, the number wheels 50*a* can be reached through the windows 302*a*.

The second embodiment further includes a locking mechanism 6 formed therein. The locking mechanism 6 includes a locking block 60 with a hook 601 on the top thereof for engagement with the flange 23*a* of the long arm 20*a* of the shackle 2*a*, a rectangular bump 602 on the bottom thereof and a spring 61 for biasing the locking block 60 to engage with the flange 23*a* of the long arm 20*a* of the shackle 2*a*.

The second embodiment further includes key-operable locking means 4*a* with a body 40*a*, a rotor 41*a* in the body 40*a* and a hemi-cylinder 44*a* extended from the rotor 41*a*. The rotor 41*a* includes a keyhole 43*a* therein for receiving a key 42*a*. The hemi-cylinder 44*a* is engaged with the rectangular bump 602 for releasing the hook 601 of the locking block 60 from the flange 23*a* of the long arm 20*a* of the shackle 2*a*.

Figure 9:
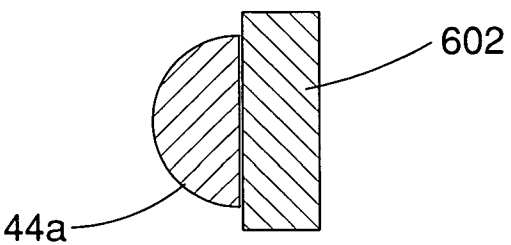
FIG. 9 is another cross-sectional view of the padlock shown in FIG. 8, showing a semi-cylinder engaged with a rectangular bump of a locking block.

Referring to FIG. 9, when a flat surface of the hemi-cylinder 44*a* is overlaid with a flat surface of the rectangular bump 602, the hook 601 is engaged with the flange 23*a* of the long arm 20*a*.

Figure 12:
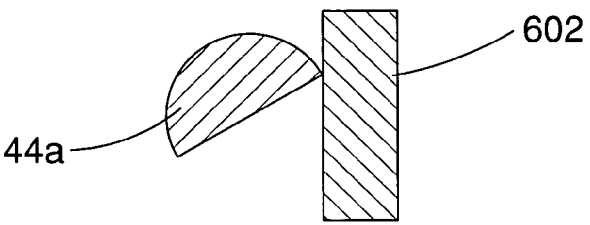
FIG. 12 is another cross-sectional view of the padlock shown in FIG. 8, showing a semi-cylinder rotated and pressed against a rectangular bump of the locking block.
Figure 11:
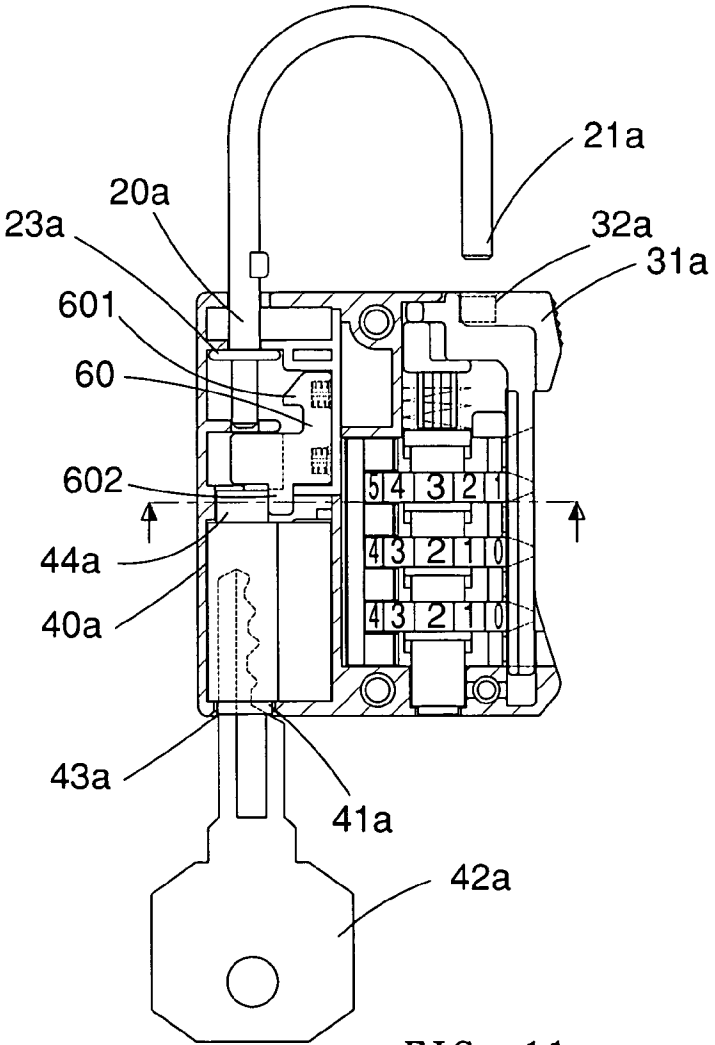
FIG. 11 is another cross-sectional view of the padlock shown in FIG. 8, showing a long arm of the shackle released from a hook of the locking block.
Figure 14:
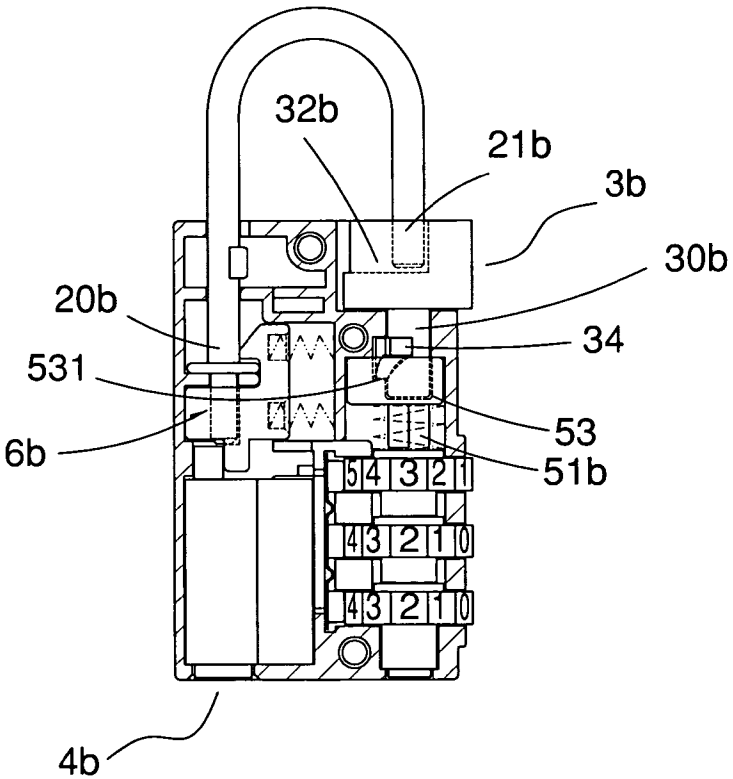
FIG. 14 is a cross-sectional view of the padlock shown in FIG. 13, showing a shackle locked.
Figure 13:
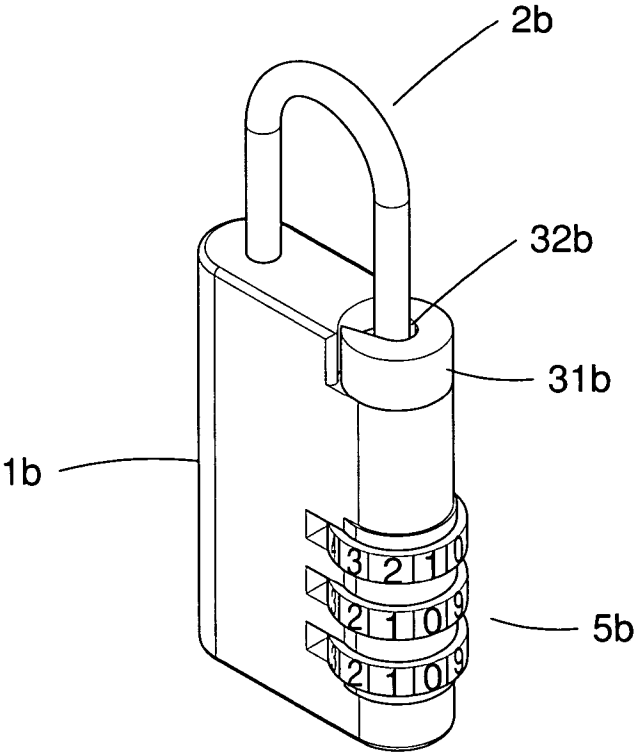
FIG. 13 is a perspective view of a padlock according to a third embodiment of the present invention.
Figure 16:
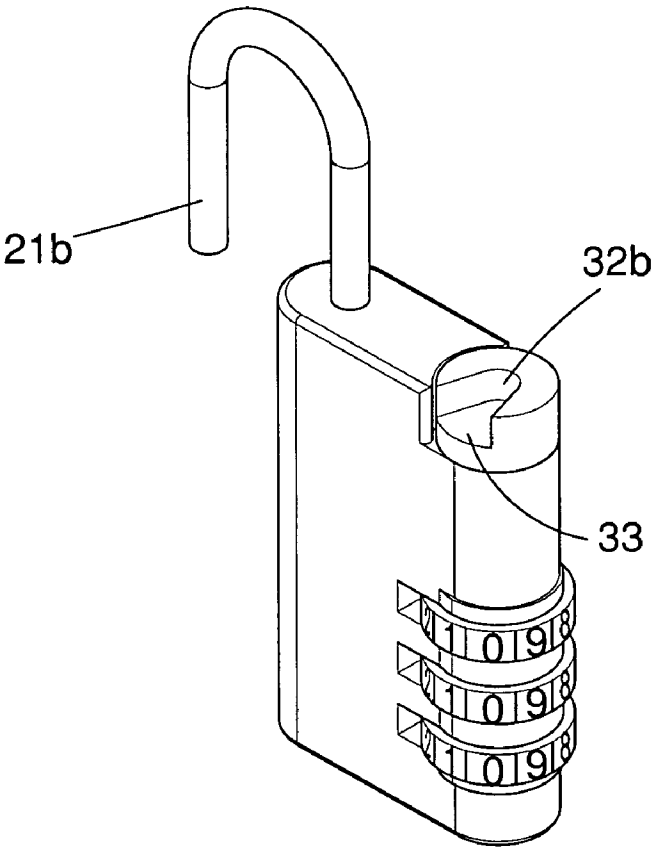
FIG. 16 is another perspective view of the padlock shown in FIG. 13, showing a gap of a receptacle of the block rotated to a position for releasing a short arm of the shackle.
Figure 15:
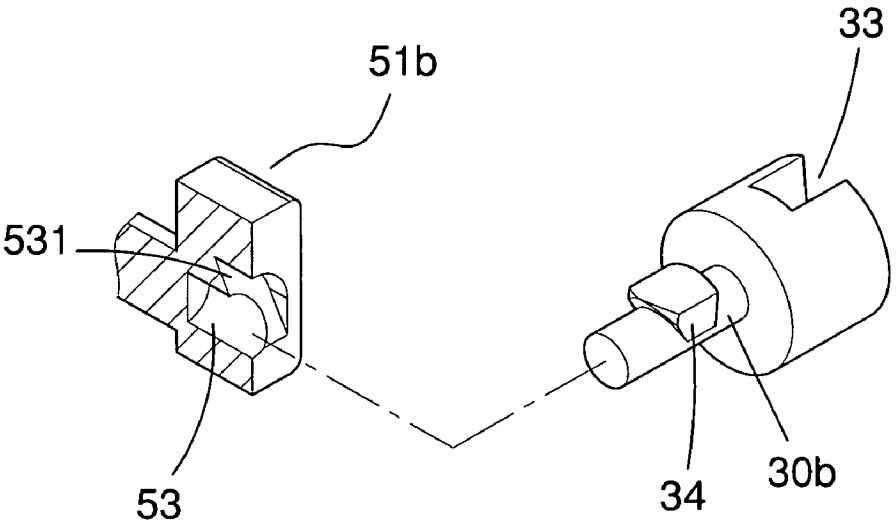
FIG. 15 is an exploded view of a block of the padlock shown in FIG. 13.

Referring to FIGS. 11 and 12, when the key 42*a* rotates and causes hemi-cylinder 44*a* is rotated by the key 42*a* to press against the rectangular bump 602 to move the locking block 60 away from the flange 23*a*, the hook 601 is disengaged from the flange 23*a* of the long arm 20*a*. Then, the long arm 20*a* is biased upward and the short arm 21*a* is removed from the receptacle 32*a*.

With reference to FIGS. 13 through 17, a padlock according to a third embodiment of the present invention includes a lock body 1*b*, a shackle 2*b*, a block 3*b*, a locking mechanism 6*b* and key-operable locking means 4*b* like the lock body 1*a*, the shackle 2*a*, the block 3*a*, the locking mechanism 6*a* and the key-operable locking means 4*a* of the second embodiment. The third embodiment further includes combination locking means 5*b* including a stem 51*b* with a recess 53 at an upper end thereof. The recess 53 includes a concave 531 in a wall thereof. The block 3*b* includes a gap 33 in communication with the receptacle 32*b* of the block 3*b*. The gap 33 includes a width larger than the diameter of the short arm 21*b* for receiving the short arm 21*b*. The mounting portion 30*b* of the block 3*b* includes a protrusion 34 thereon for engagement with the concave 531. The mounting portion 30*b* is disposed in the recess 53. After the combination locking means 5*b* is dialed to an unlocking number, the gap 33 is rotated to a position where the short arm 21*b* of the shackle 2*b* can be removed from the gap 33.

The first, second and third embodiments include similar structures including the key-operable locking means 4, 4*a*, 4*b* for locking and unlocking the long arms 20, 20*a* and 20*b* of the shackles 2, 2*a* and 2*b* and the combination locking means 5, 5*a*, 5*b* for controlling the blocks 3, 3*a* and 3*b* so that the block 3, 3*a* and 3*b* can be engaged with and disengaged from the short arm 21, 21*a* and 21*b* of the shackle 2, 2*a* and 2*b*. However, other arrangements as follows also work.

With reference to FIGS. 18 through 23, the padlock according to a fourth embodiment of the present invention includes a lock body 70, a block 72, a shackle 71, combination locking means 9 and key-operable locking means 8.

The lock body 70 includes a first channel 701 therein, a second channel 702 therein, a space 703 in a corner thereof and a wall 7031 formed thereon so that the wall 7031 stands by the space 703.

The block 72 includes a mounting portion 721, an engaging portion 722 and a neck 720 formed between the mounting portion 721 and the engaging portion 722. The mounting portion 721 includes two sockets 724 therein. The engaging portion 722 includes a receptacle 723 in the top and a gap 725 in the periphery and in communication with the receptacle 723. The diameter of the neck 720 is smaller than that of the mounting portion 721 and the mounting portion 722.

The mounting portion 721 is disposed in the lock body 71. The neck 720 is disposed in the second channel 702. The engaging portion 722 is disposed in the space 703.

The shackle 71 includes a long arm 711 movably disposed in the first channel 701 and a short arm 712 for insertion in the receptacle 723 of the block 72. The long arm 711 of the shackle 71 includes a stop 714 at an end thereof. The size of the stop 714 is larger than that of an opening of the first channel 701 for preventing the long arm 711 from fully sliding off the first channel 701. The diameter of the short arm 712 is smaller than the width of the gap 725 so that the short arm 712 can be moved through the gap 725.

The combination locking means 9 is disposed in the lock body 70 for locking and unlocking the long arm 711 of the shackle 71. The combination locking means 9 includes a stem 91 for engagement with the stop 714 of the long arm 711 of the shackle 71 and plural number wheels 90 rotationally mounted on the stem 91 for locking and unlocking the long arm 711 of the shackle 71. When the combination locking means 9 is dialed to an unlocking number, the stop 714 is released from the stem 91 and the long arm 711 is biased upwardly so that the short arm 712 is removed from the receptacle 723.

The key-operable locking means 8 is disposed in the lock body 70 for controlling the block 72 so that the block 72 can be engaged with and disengaged from the short arm 712 of the shackle 71. The key-operable locking means 8 includes a body 80, a rotor 81 disposed in the body 80, a driving rod 813 extended from the rotor 81 and two plates extended from the driving rod 813. The rotor 81 includes a keyhole 811 therein for receiving a key 82. The plates 812 are disposed in the sockets 724 so that the rotor 81 can rotate the block 72.

Figure 18:
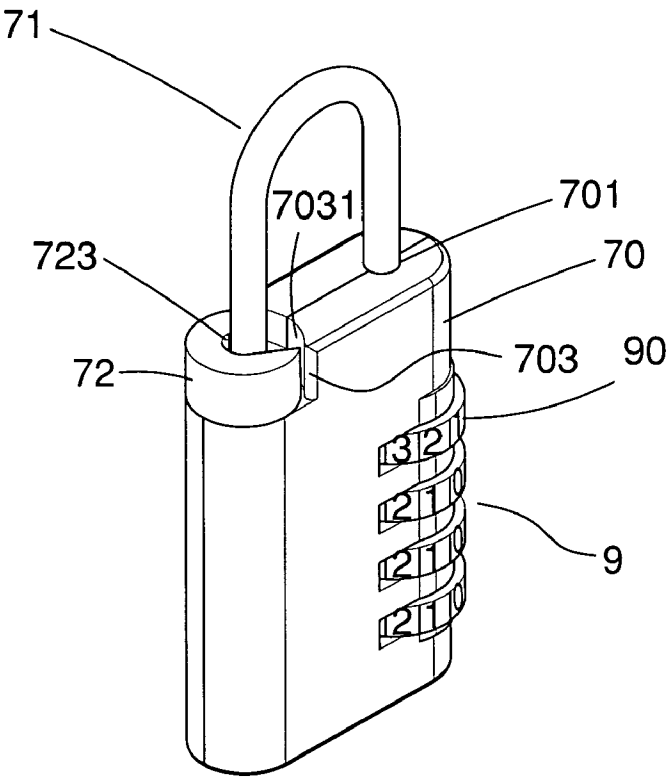
FIG. 18 is a perspective view of a padlock according to a fourth embodiment of the present invention.
Figure 17:
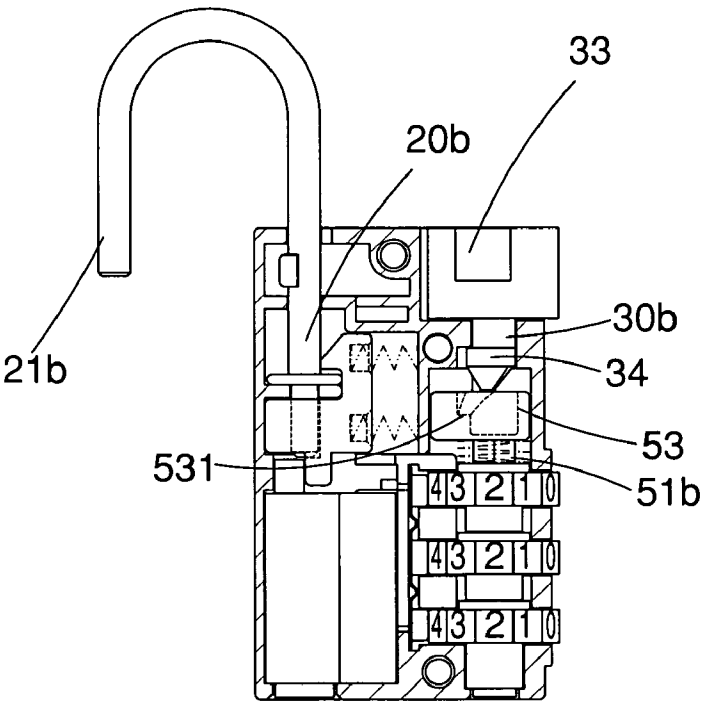
FIG. 17 is a cross-sectional view of the padlock shown in FIG. 13, showing the short arm of the shackle released from the gap of the receptacle of the block.
Figure 20:
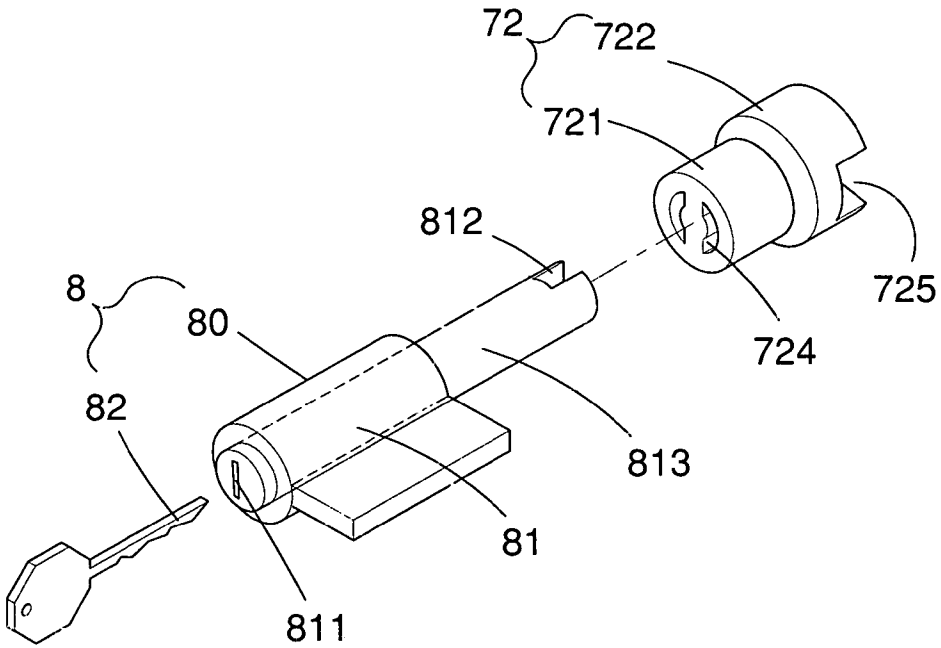
FIG. 20 is an exploded view of key-operable locking means and a block of the padlock shown in FIG. 18.
Figure 19:
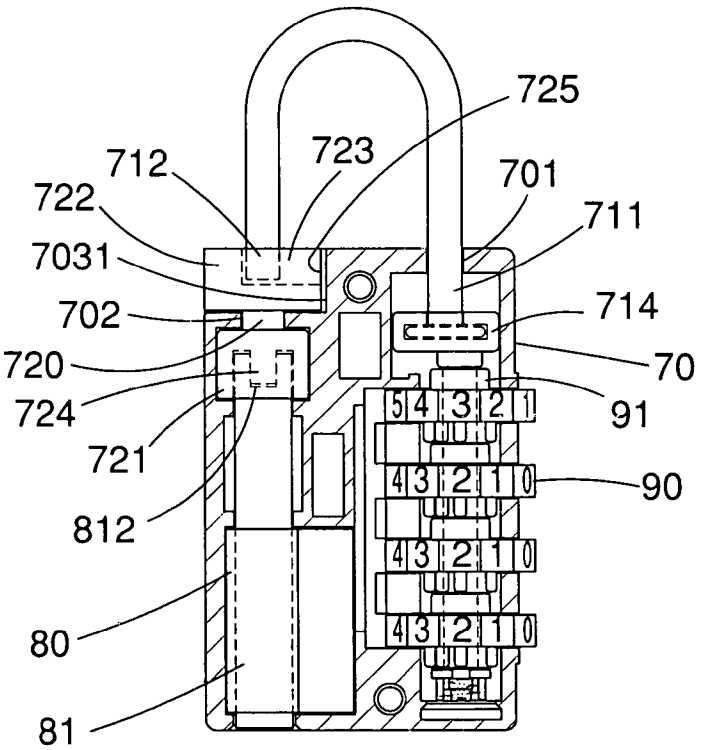
FIG. 19 is a cross-sectional view of the padlock shown in FIG. 18, showing a shackle locked.
Figure 22:
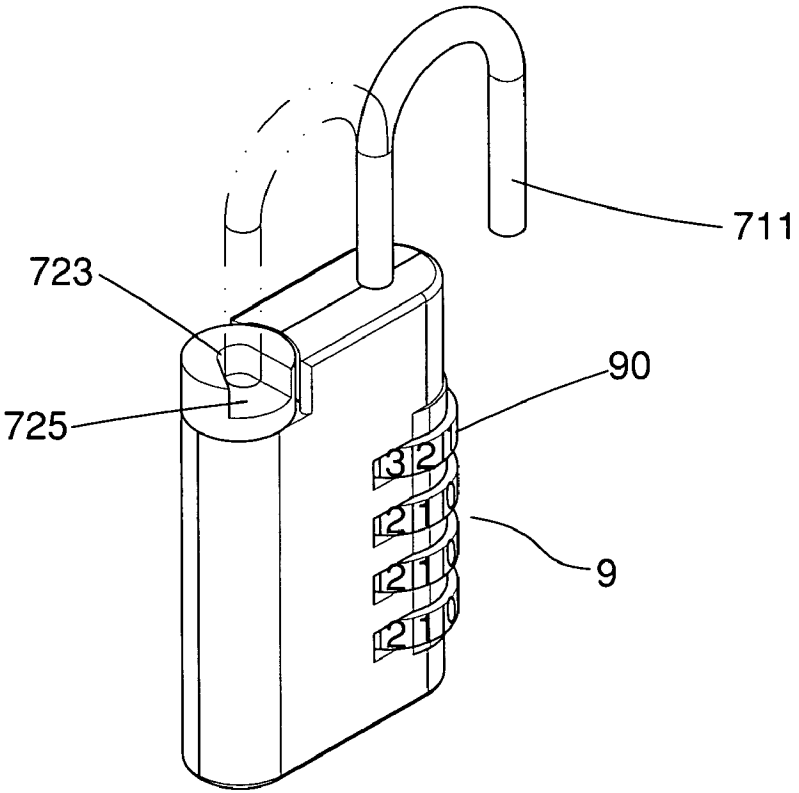
FIG. 22 is another perspective view of the padlock shown in FIG. 18, showing a slot of an engaging portion of the block rotated to a position for releasing a short arm of the shackle.
Figure 21:
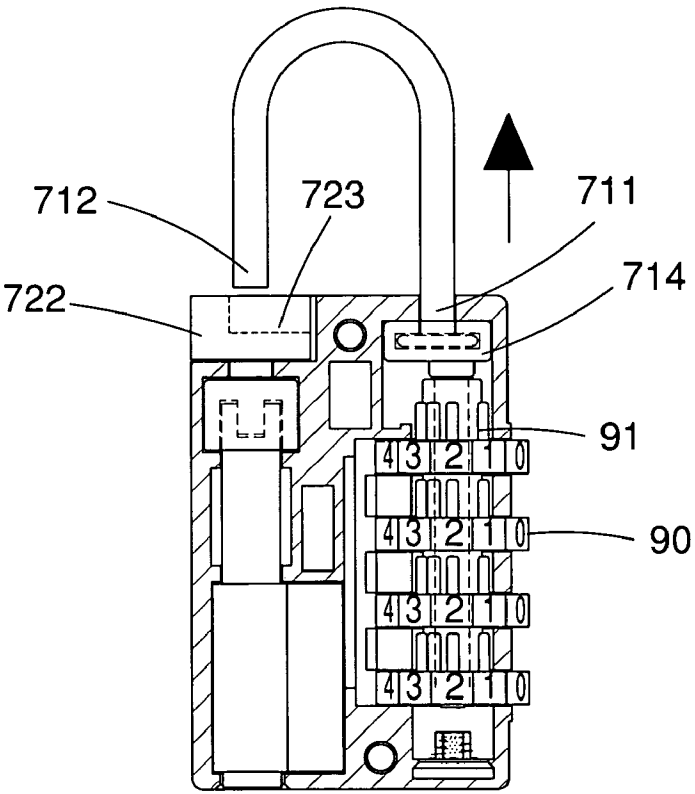
FIG. 21 is a cross-sectional view of the padlock shown in FIG. 18, showing a long arm of the shackle released from combination locking means.
Figure 24:
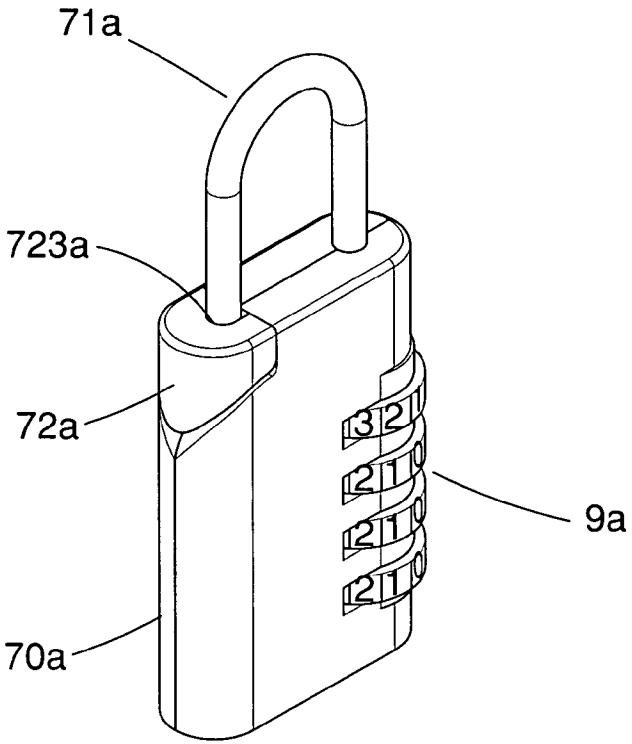
FIG. 24 is a perspective view of a padlock according to a fifth embodiment of the present invention.
Figure 23:
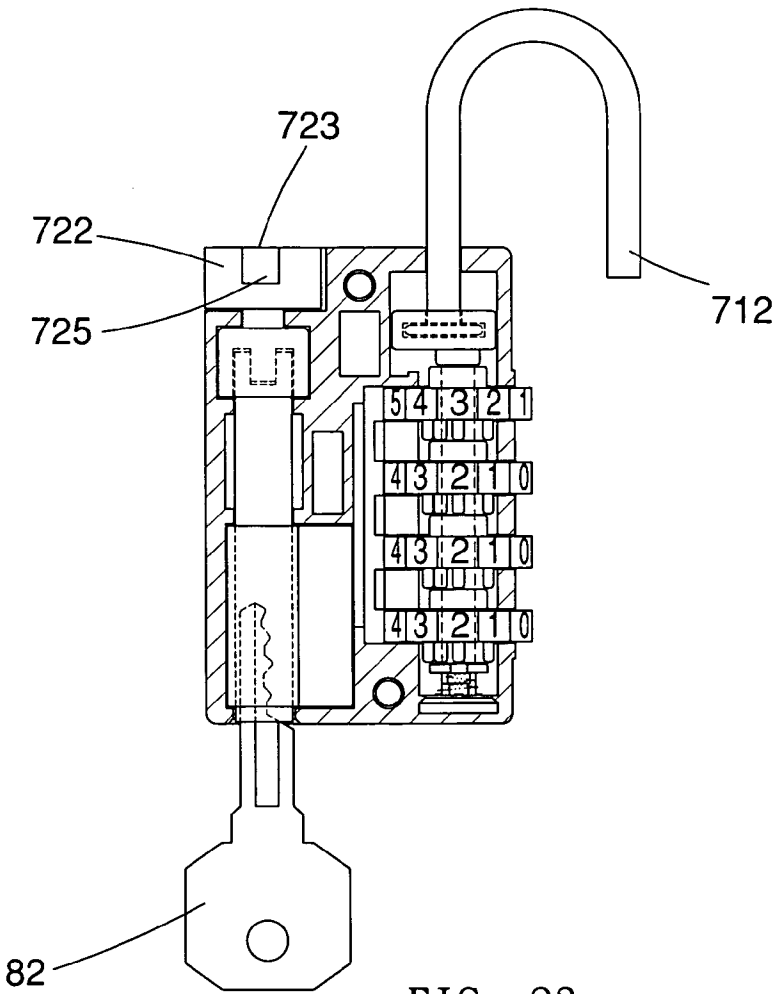
FIG. 23 is a cross-sectional view of the padlock shown in FIG. 18, showing the slot of the engaging portion of the block rotated by a key and the short arm of the shackle removed from the slot.
Figure 26:
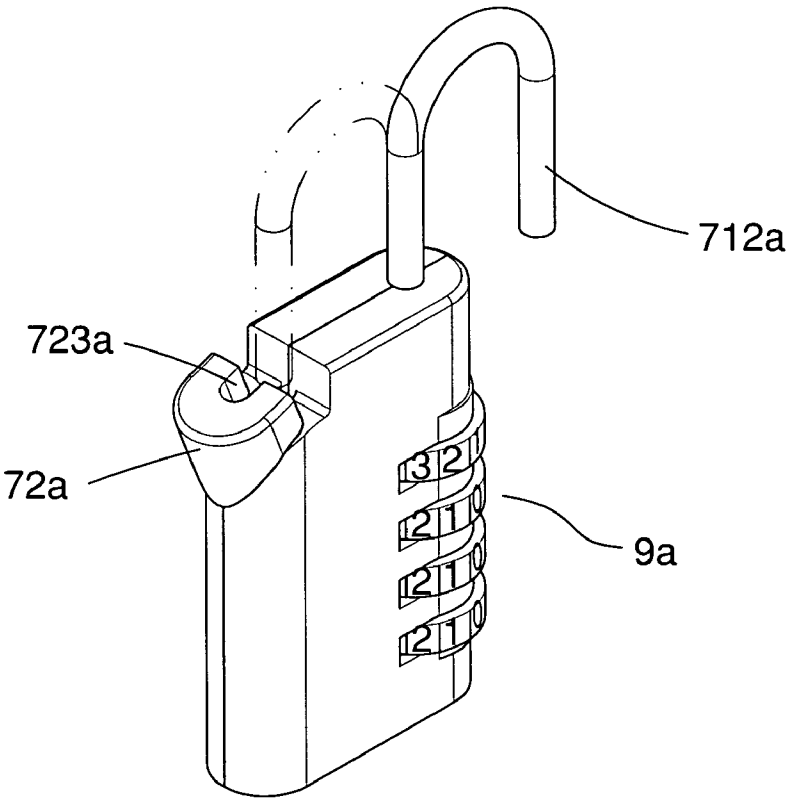
FIG. 26 is another perspective view of the padlock shown in FIG. 24, showing the block rotated to allow a short arm of the shackle released from the slot.

As shown in FIG. 18, the block 72 is in a locking position where the gap 725 thereof is completely blocked by the wall 7031 of the lock body 70. Thus, the short arm 712 of the shackle 71 is restrained in the receptacle 723 of the block 72.

The key 82 can rotate the rotor 81. The rotor 81 can in turn rotate the block 72 to an unlocking position where the gap 725 of the locking block 72 is not blocked by the wall 7031 of the body 70. Thus, the short arm 712 of the shackle 71 can be removed from the receptacle 723 of the block 72 through the gap 725.

With reference to FIGS. 24 through 27, a padlock according to a fifth embodiment of the present invention includes a lock body 70*a*, a block 72*a*, a spring 724*a*, a shackle 71*a*, combination locking means 9*a* and key-operable locking means 8*a*. The lock body 70*a* includes a channel 701*a* therein.

The block 72*a* is pivotally disposed in the lock body 70*a*. The block 72*a* includes a slot 723*a* therein. The spring 724*a* is engaged with the block 72*a* for returning the locking block 72*a* to its original position.

The shackle 71*a* includes a long arm 711*a* movably disposed in the channel 701*a* and a short arm 712*a* for insertion in the slot 723*a* of the block 72*a*.

The combination locking means 9*a* is disposed in the lock body 70*a* for locking and unlocking the long arm 711*a* of the shackle 71*a*. The combination locking means 9*a* of the fifth embodiment is identical to the combination locking means 9 of the fourth embodiment.

The key-operable locking means 8*a* is disposed in the lock body 70*a* for controlling the rotation of the block 72*a* so that the block 72*a* can be engaged with and disengaged from the short arm 712*a* of the shackle 71*a*. The block 72*a* includes a protrusion 721*a* formed thereon. The key-operable locking means 8*a* includes a body, a rotor 81*a* in the body and a hemi-cylinder 812*a* on the rotor 81*a*. The rotor 81*a* includes a keyhole 83*a* therein for receiving a key 82*a*. The hemi-cylinder 812*a* is engaged with the protrusion 721*a* of the block 72*a*.

Figure 25:
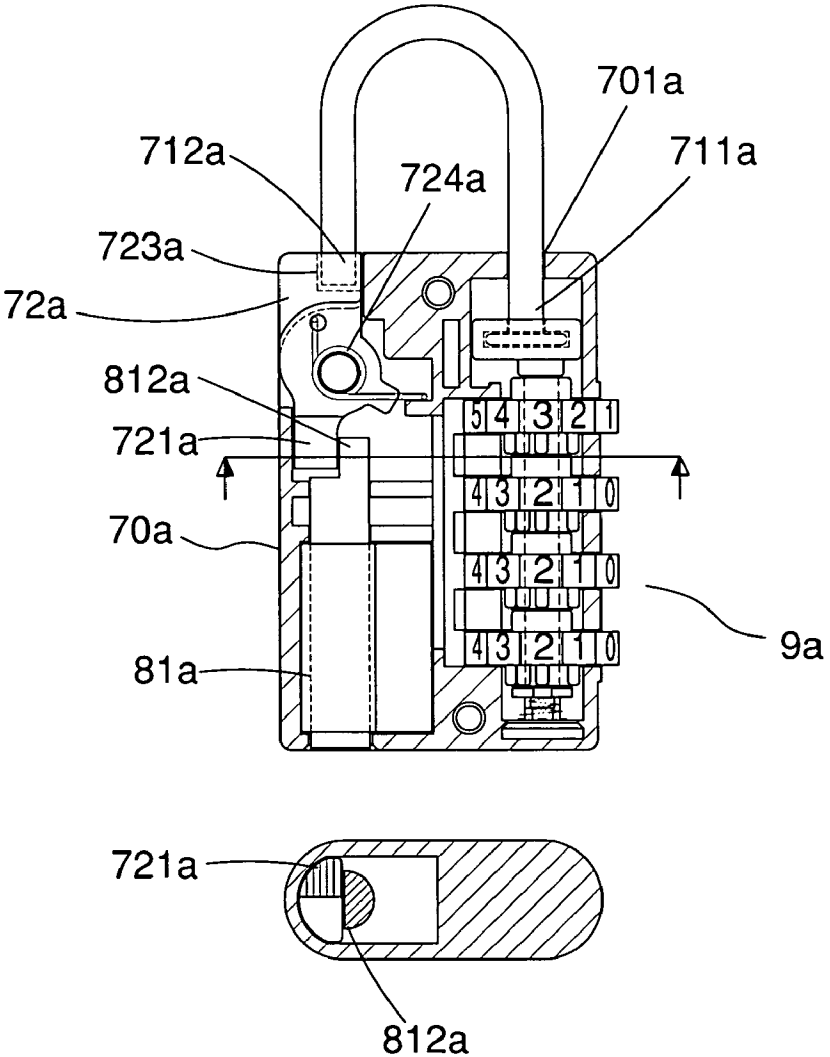
FIG. 25 is a cross-sectional view of the padlock shown in FIG. 24, showing a shackle locked and a protrusion of a block engaged with a hemi-cylinder for preventing the block from rotation.
Figure 28:
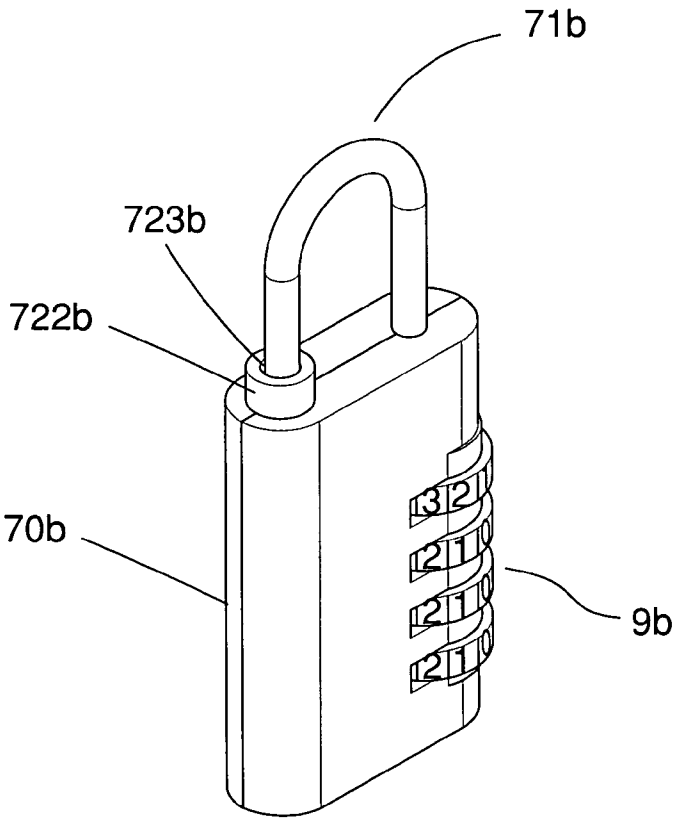
FIG. 28 is a perspective view of a padlock according to a sixth embodiment of the present invention.

Referring to FIG. 25, the protrusion 721*a* is engaged with the hemi-cylinder 812*a*. Thus, the block 72*a* is prevented from rotation.

Figure 27:
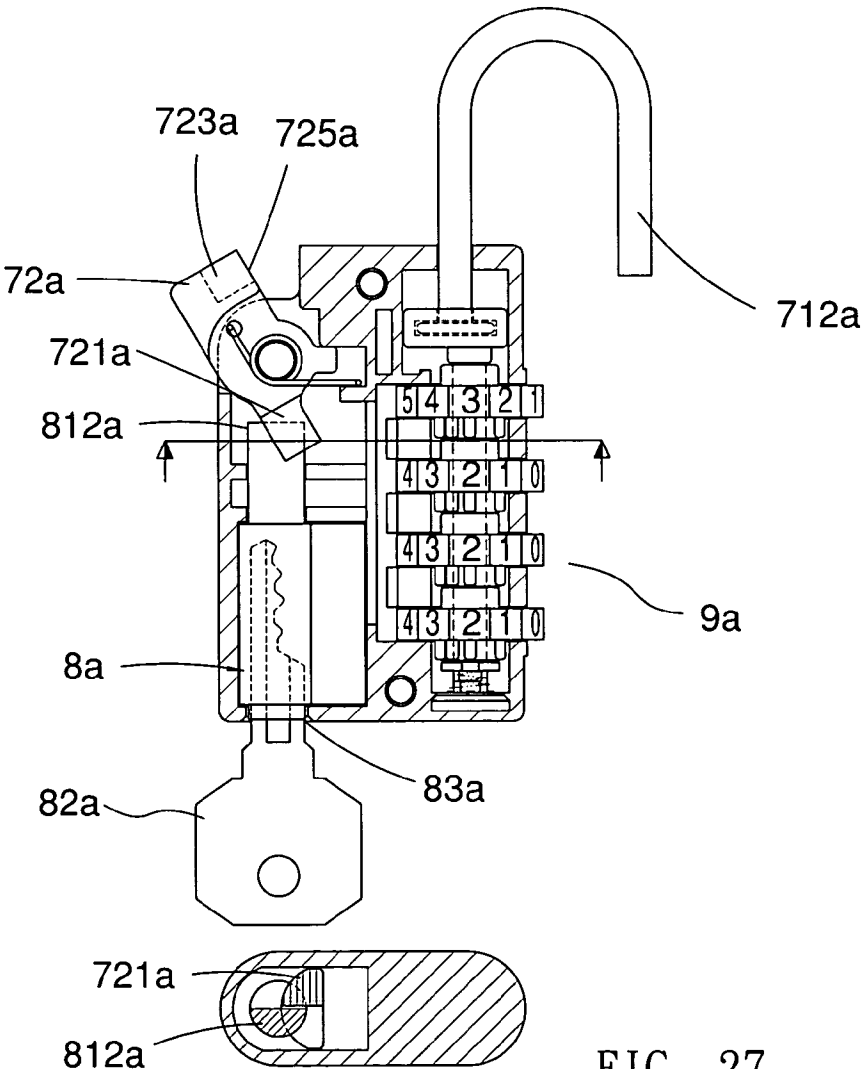
FIG. 27 is a cross-sectional view of the padlock shown in FIG. 24, showing the key rotating the hemi-cylinder to a position for allowing the rotation of the block to allow the release of the short arm of the shackle from the slot.

Referring to FIG. 27, the key 82*a* rotates the rotor 81*a* and the hemi-cylinder 812*a* to a position where the block 72*a* can be pivoted to allow the removal of the short arm 712*a* from the slot 723*a*.

With reference to FIGS. 28 through 31, a padlock according to a sixth embodiment of the present invention includes a lock body 70*b*, a shackle 71*b*, key-operable locking means 8*b* and combination locking means 9*b* like their counterparts of the fourth embodiment.

Figure 30:
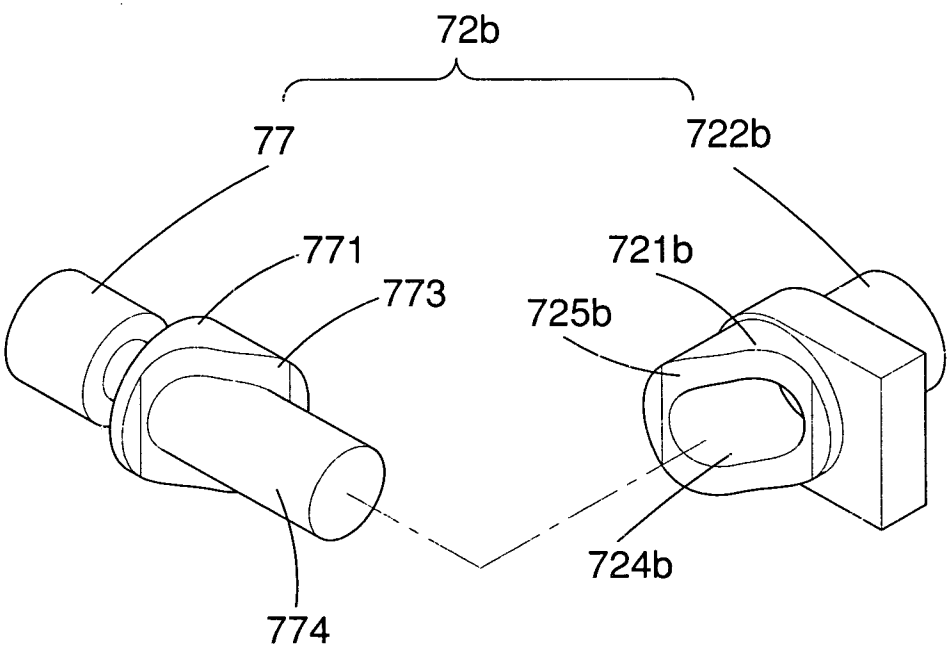
FIG. 30 is an exploded view of an engaging block and a mounting block of a block of the padlock shown in FIG. 28.

Referring to FIG. 30, a block 72*b* includes an engaging portion 722*b* and a mounting portion 77. The engaging portion 722*b* includes a column 721*b* at one end thereof, a hole 724*b* in the column 721*b* and an inclined surface on the column 721*b*. The mounting portion 77 includes a column 771 thereon, an inclined surface 773 on the column 771 and a shaft 774 extended from the column 771. The shaft 774 is rotationally and movably inserted in the hole 724*b*. The inclined surface 773 of the mounting portion 77 is used for contact with the inclined surface 725*b* of the engaging portion 722*b*.

Figure 29:
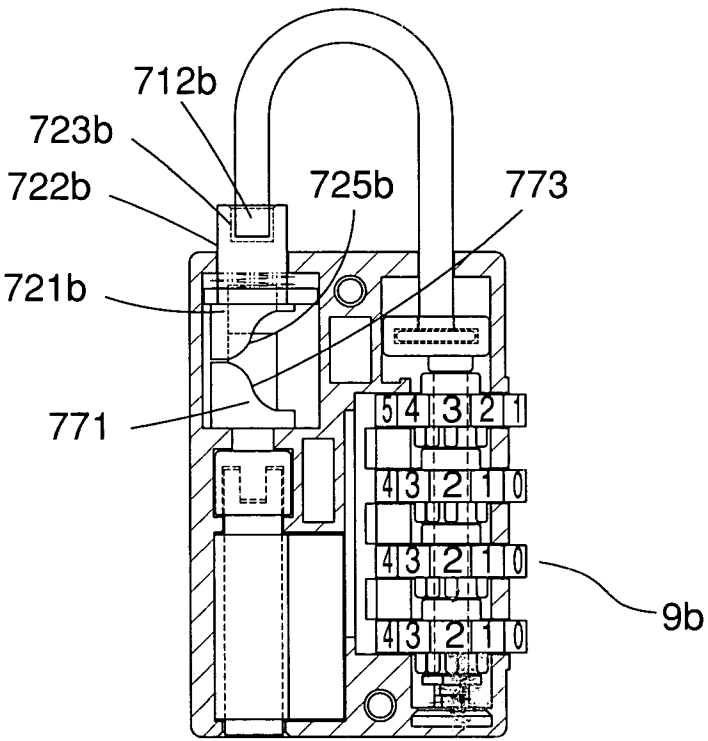
FIG. 29 is a cross-sectional view of the padlock shown in FIG. 28, showing a shackle locked.

Referring to FIG. 29, when the padlock is locked, only the top of the inclined surface 725*b* of the engaging portion 722*b* contacts the top of the inclined surface 773 of the mounting portion 77. The total height of the block 72 is the largest.

Figure 31:
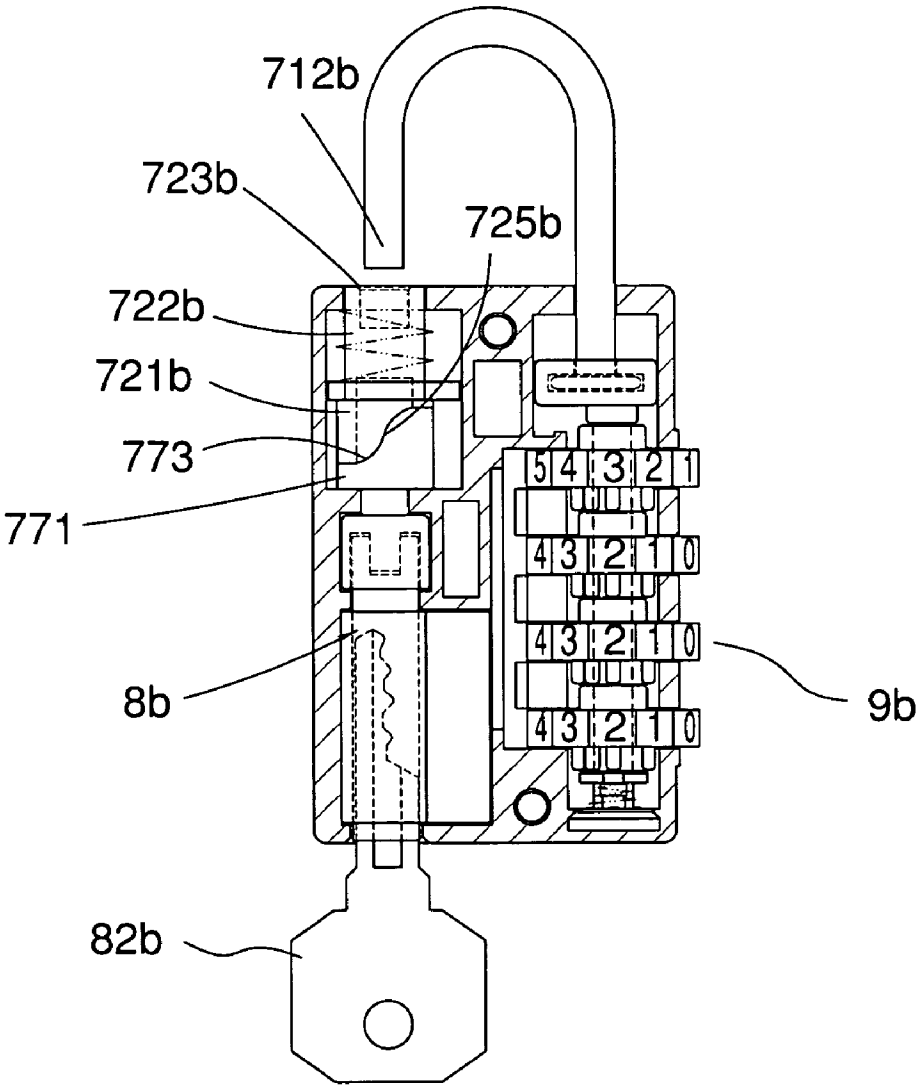
FIG. 31 is a cross-sectional view of the padlock shown in FIG. 28, showing the block moved downwardly for releasing a short arm of the shackle.

Referring to FIG. 31, the padlock is unlocked by the key 82*b* so that the inclined surface 725*b* of the engaging portion 722*b* is aligned with the inclined surface 773 of the mounting portion 77. A spring is used to bias the engaging portion 722*b* downwards. Thus, the inclined surface 725*b* of the engaging portion 722*b* entirely contacts the inclined surface 773 of the mounting portion 77. The total height of the block 72*b* is the smallest. The engaging portion 722*b* of the block 72*b* is retreated into the lock body 70*b* so that the short arm 712*b* of the shackle 71*b* can be released from the receptacle 723*b*.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A padlock comprising:

a lock body comprising:

a first channel therein;

a second channel therein;

a space in a corner thereof; and a wall facing said space;

a block comprising:

an engaging portion received in said space of said lock body and comprising a top defining a receptacle and a side defining a gap in communication with said receptacle;

a mounting portion; and a neck formed between said engaging portion and said mounting portion and disposed in said second channel, wherein a diameter of said neck is smaller than that of said engaging portion;

a shackle comprising a long arm movably inserted in said first channel and a short arm for engagement with said block through either one of said receptacle and said gap;

combination locking means disposed in said lock body and connected to said long arm of said shackle for locking and unlocking said shackle; and key-operable locking means disposed in said lock body for controlling said block so that said block can be engaged with or disengaged from said short arm of said shackle, wherein said key-operable locking means comprises:

a body;

a rotor disposed in said body;

a driving rod extended from said rotor and connected to said mounting portion of said block; and a keyhole defined in said rotor for receiving a key.

2. The padlock according to claim 1, wherein said diameter of said neck is smaller than that of said mounting portion.

3. The padlock according to claim 1, wherein said mounting portion comprises two sockets, and said driving rod comprises two plates inserted in said sockets so that said driving rod can rotate said block.

* * * * *